US005158216A

United States Patent [19]

Viani

[11] Patent Number: 5,158,216

[45] Date of Patent: Oct. 27, 1992

[54] PITCHER FIRST POURING LIQUID AT BOTTOM

[76] Inventor: Mark C. Viani, 25 Clavedon Ct., Middletown, N.J. 07748

[21] Appl. No.: 579,713

[22] Filed: Sep. 10, 1990

[51] Int. Cl.[5] ..... A47G 19/14

[52] U.S. Cl. ..... 222/465.1; 222/572

[58] Field of Search ..... 222/465.1, 472–475, 222/468, 572; 220/94 A, 337

[56] References Cited

U.S. PATENT DOCUMENTS

| | | | |
|---|---|---|---|
| D. 229,012 | 11/1973 | Wooters | 222/465.1 |
| 617,973 | 1/1899 | Sulzbacher | 222/465.1 |
| 957,005 | 5/1910 | Sherman | 222/468 |
| 1,894,575 | 1/1933 | Sherman | 220/337 |
| 2,233,996 | 3/1941 | Dent | 222/465.1 |
| 2,815,155 | 12/1957 | Roche | 222/572 |
| 2,887,256 | 5/1959 | Thornhill | 222/572 |
| 3,105,619 | 10/1963 | Rohrmuller | 222/470 |
| 3,414,165 | 12/1968 | Goodenow | 222/572 |
| 4,558,799 | 12/1985 | Hammond | 220/337 |

FOREIGN PATENT DOCUMENTS

| | | | |
|---|---|---|---|
| 2090726 | 7/1982 | United Kingdom | 222/566 |

*Primary Examiner*—Andres Kashnikow
*Assistant Examiner*—Philippe Derakshani
*Attorney, Agent, or Firm*—Charles I. Brodsky

[57] ABSTRACT

A pitcher, particularly attractive for keg or draft beer (or soda), is described in which the pour flow is of the liquid at the bottom of the pitcher, keeping any foam or ice within the pitcher, at the top. An insert is incorporated adjacent the spout end of the pitcher, and extends from appropriate ¼ inch above the bottom to the top cover of the pitcher. This insert forms a barrier for the spout to force the flow through the spout to be of the liquid from the bottom. A handle is located on a side opposite to the spout for ease of pouring.

5 Claims, 3 Drawing Sheets

PITCHER FIRST POURING LIQUID AT BOTTOM

This specification is the subject of a disclosure document filed on Jan. 29, 1990, under Ser. No. 2442-90.

FIELD OF THE INVENTION

This invention relates to pitchers, in general, and to similar such dispensing containers in which the flow is to be of a liquid at the bottom, rather than of the liquid at the top of the container.

BACKGROUND OF THE INVENTION

At parties and at restaurants, it is not uncommon for the guests to be served pitchers of beer, soda, or water. Where the beer is of a keg or draft variety, it is typical to find that there is a large head of foam at the top; where the pitcher is filled with soda or water, there usually are included ice cubes floating at the top. The pitchers most often utilized, however, offer several disadvantages: a) when used for pouring the keg or draft beer, what first gets poured is the foam, so that the glass which is filled ends up with some liquid, and a good deal of foam; b) when the pouring is of the soda or water, the ice cubes tend to block the spout, restricting the flow of the liquid —raising the angle to try to increase the liquid flow only tends to dislodge the blocked ice cubes, with a common result that the ice cubes flow into the glass, sometimes to the extent of having more ice cubes in the glass than the liquid; c) the designs of the pitchers do not readily lend themselves to be stored, one atop the other; and d) they are not conducive to later refrigeration for subsequent use because of the open-nature of the top—aside from being easily spillable if accidentally knocked over.

While pitchers sold for home use typically come with a cover (so as to reduce the tendencies for spillage if knocked over, and so as to permit stored refrigeration without fear of something being knocked into the liquid), they continue to suffer the disadvantages associated with the ice cube blockage of the pouring spout when the pitcher is used for the pouring of soda, iced tea, iced coffee and the like.

SUMMARY OF THE INVENTION

As will become clear from the following description, a pitcher embodying the principles of the invention incorporates an insert adjacent to the spout end of the pitcher, extending from approximately ¼ inch above the bottom to the top cover of the pitcher. As will be seen, this insert forms a barrier for the spout, so as to force the flow through the spout to be of the liquid at the bottom of the pitcher. With a handle being located on the side of the pitcher opposite to the spout (for ease of pouring), the pour then becomes one in which the flow is of the liquid at the bottom of the pitcher—thereby keeping any foam or ice within the pitcher, at its closed top.

In accordance with a preferred embodiment, a small spout is employed, at the top of the pitcher, where it joins with the front of a flush cover lid. In this embodiment, the lid only covers the front half of the pitcher, leaving an opening into the back-half in which the beer, soda, iced tea, iced coffee, or other liquid, may be introduced. In an alternative embodiment, the cover enclosure can also include a hinged back-half, so as to permit the total closing of the pitcher after the liquid has been introduced, to facilitate the subsequent refrigeration of the pitcher, without a possibility of foreign material falling inside the container. With either embodiment, as will be seen, the cover enclosure can be dimensioned so as to snap-fit onto the pitcher in securing the cover in place. (As will also be appreciated, having the cover not only flush, but extending across the entire top opening of the pitcher, enables the pitchers to be stored easily, one-atop-the-other, when not in use.

BRIEF DESCRIPTION OF THE DRAWING

These and other features of the invention will be more clearly understood from a consideration of the following description, taken in connection with the accompanying drawing, in which.

DETAILED DESCRIPTION OF THE DRAWING

Figure 1:
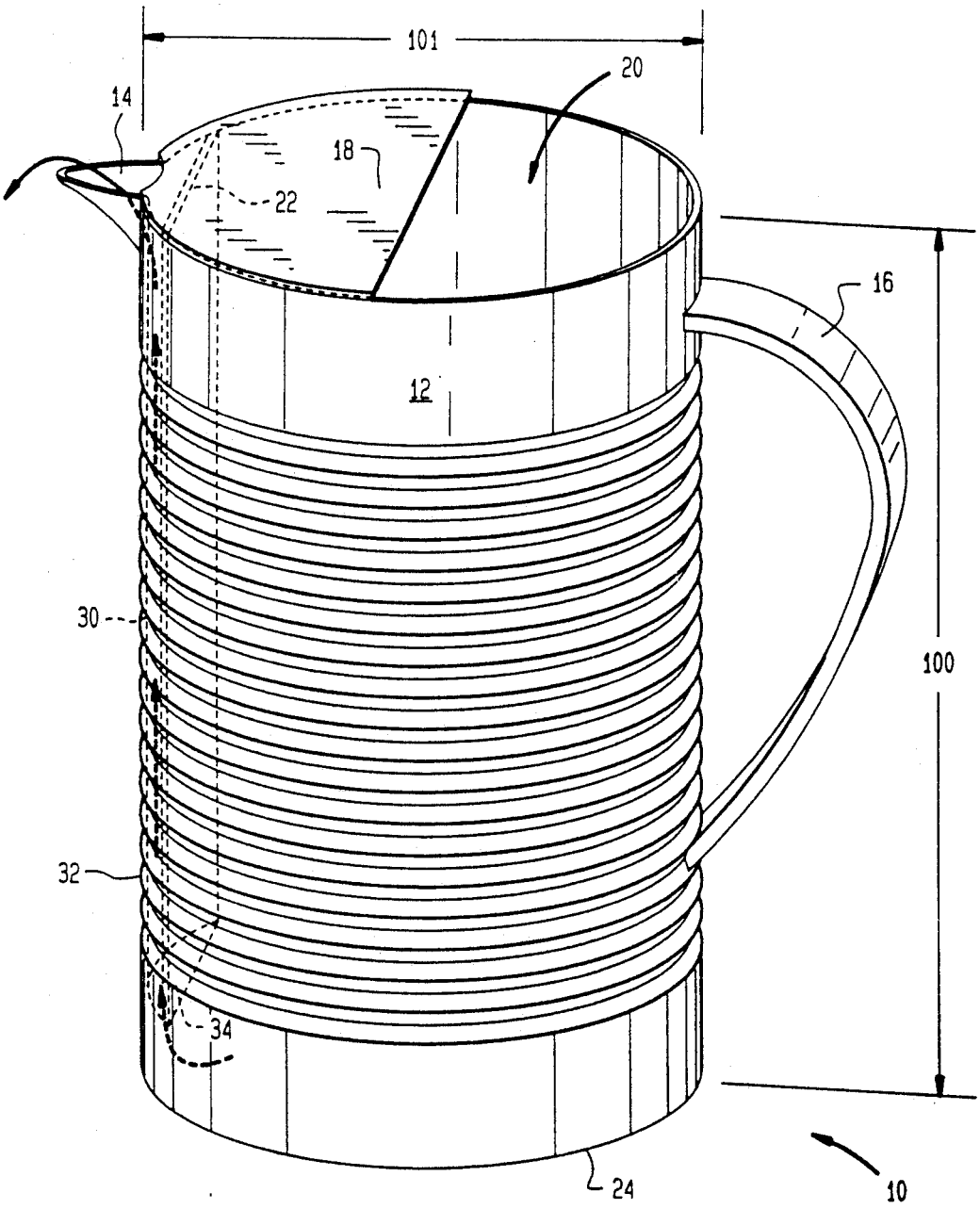
FIG. 1 illustrates a side-view of a party pitcher as it would appear in a preferred embodiment of the invention.

Referring to the drawing, the pitcher 10 includes a container 12 in which the liquid is stored, to be poured through a spout 14, upon the grasping of a handle 16, and by the tilting forward of the container 12. In accordance with a preferred embodiment of the invention, the spout 14 is located at the top front end of the container 12, where it meets with an included flush fitting cover lid 18, extending across the top-front of the container 12, approximately half way. For a pitcher of height 100 of some 9 inches, a top radius 101 of 5½ inches, the spout dimensions 101 and 103 would preferably be of the order of 1 inch each. As will be noted, the handle 16 is positioned diametrically opposite the spout 14, and, as will be understood, the cover-lid 18 snaps onto the top side of the container 12.

Figure 2:
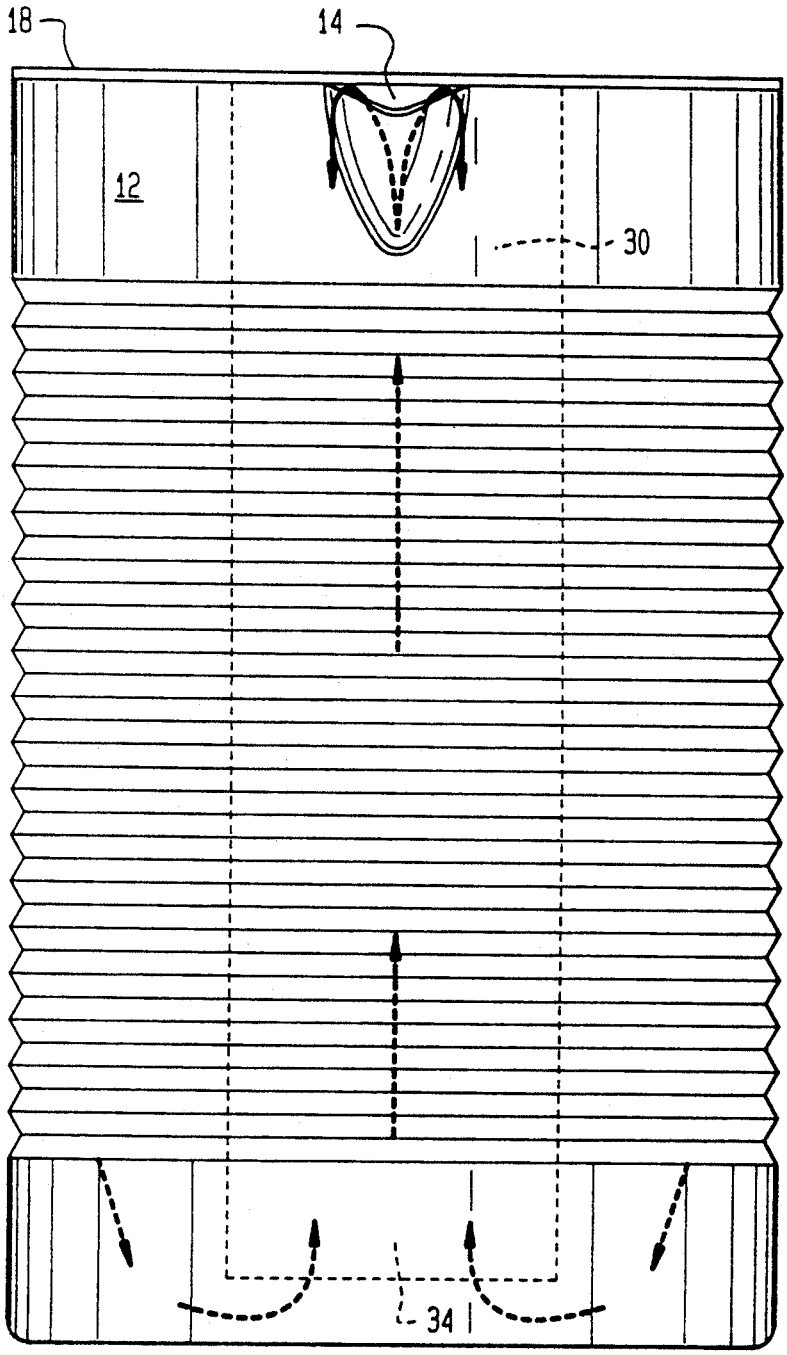
FIG. 2 is a front view of the pitcher of FIG. 1.
Figure 3:
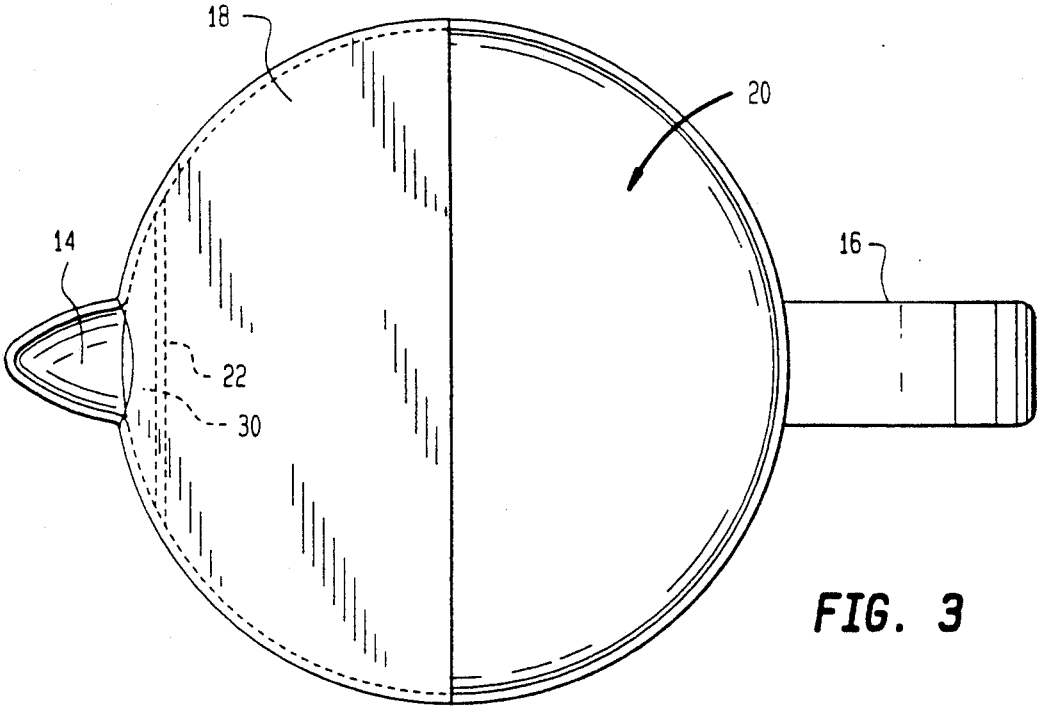
FIG. 3 is a top view of the pitcher of FIG. 1.

As will be understood from FIGS. 1 and 3, liquids—be they in the form of keg beer, draft beer, soda, iced tea, iced coffee and the like—are introduced into the container 12 through the open end 20 to whatever height is desired. Internal of the container 12, however, is an insert 22 adjacent the spout end of the container, extending from approximately ¼ inch above the bottom of the container 24, to the top lid cover 18. As will be appreciated from the front view of FIG. 2, the insert 22 extends, additionally, between the inner walls of the container where it is positioned—such that, for a container 12 of cylindrical configuration, the insert 22 is of the form of a semicircular insert (or even a rectangular insert), of the configuration to fit flush with the inner walls of the of the container 12, to an extent that seepage through the side join is prevented. In such manner, and as will be appreciated, then, any tilting forwardly of the pitcher 10 would then cause liquid to pour from the spout 14 only by way of entering the channel 30 formed between the insert 22 and the outer wall 32 of the container 12, by entering the spacing 34 existing between the insert 22 and the bottom of the container 24.

Thus, and in accordance with the invention, any material stored within the container 12 that is lighter than the liquid introduced will float, or rise, to the top, and will not be poured through the channel 30 during the pouring of the liquid when the pitcher 10 is tilted forwardly. At the same time, it will be appreciated that the first liquid to be poured from the spout 14 will be that liquid nearer to the opening 34 adjacent the bottom of the container 12, so that in the instance where the liquid includes a head of foam, or a series of ice cubes, that head of foam, and those ice cubes, will not pour until the pitcher 10 is almost entirely empty. Even in such situation, further more, it will be noted that only those ice cubes that might be pourable will be those that are small enough to fit within the opening 34, while any remaining larger ice cubes will be blocked. In such manner, the disadvantages existing with the pitchers typically used are thus overcome.

Figure 4:
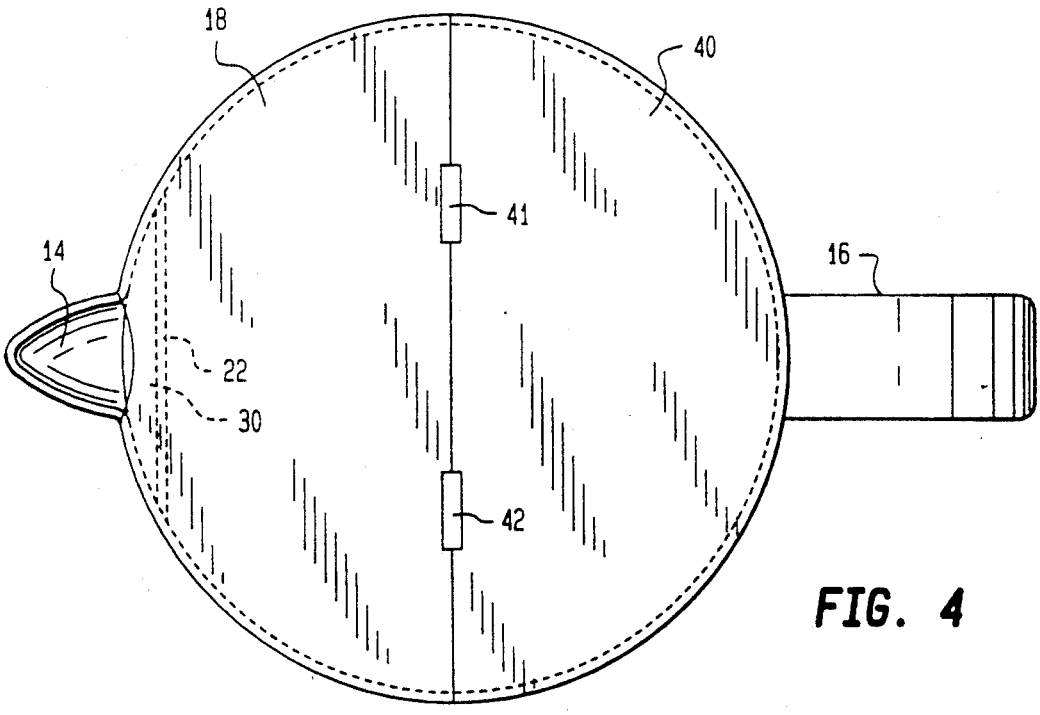
FIG. 4 is a top view of the pitcher of FIG. 1, but with an alternative flush-cover enclosure.

FIG. 4 illustrates an alternative embodiment in which the half-cover lid 18 is modified to additionally have a rear-half portion 40, which is connected to the front-half portion 18 through any appropriate means, as by a pair of hinges 42. Such rear-half 40, when closed, also snaps-tight onto the walls of the container 12 when closed, and is flipped openly upwardly when it is desired to introduce the beer, soda, etc. into the container. The use of this modified cover enables the easy storing of one pitcher atop the other—as might be used in a restaurant setting —and also proves advantageous when it is desired to refrigerate a pitcher which continues to be partly filled. By closing the rear-half 40, at such time, the contents of the pitcher 10 can be kept fresh, and the closed-off cover limits any possibility of another food product, or any other item, from falling within. This can be additionally enhanced, as will be apparent, by incorporating a strain at the juncture, where the spout 14 meets with the channel 30 of the container 12.

As will be appreciated, by utilizing covers which snap-onto the container 12 in use, those same covers can be removed when it is desired to clean the inside of the container. By using the top cover lid 40 and closing off entirely the top cover, any possibility of liquid spillage from the top is even further enhanced, as would be particularly important if the pitcher 12 were accidentally knocked-over. And, as will be understood, utilizing the front cover-lid 18 of a closed construction, any tendency for foam, liquid or ice cubes to pour out over the spout 14 when the pitcher 10 is fully or extensively filled, is also minimized. Thus, situations are minimized where possibilities might exist for ice cubes, in particular, suddenly moving forward when the angle of tilt is so great and to themselves pour into a glass, at the same time that the liquid is filling it.

In a preferred method of manufacturing the pitcher of the invention, a molding process is utilized, wherein the pitcher components are all made of plastic. For all intents and purposes, then, the pitcher, from the outside, will look no different than those conventionally used, as all the modifications that produce the improved pouring are included internal of the container configuration. To the naked eye then, from the outside, the party pitcher of the invention would just look the same as a typically employed pitcher, except that the pitcher of the invention forces the flow through the spout 14 to be of the liquid at the bottom of the container. And, as will be seen, by employing a very small spout at the top of the container 12, tendencies for the spout to be accidentally knocked-into, and broken off, are also significantly reduced to extend the usefulness of its existence.

While there have been described what are considered to be preferred embodiments of the above invention, it will be readily appreciated that modifications can be made by those skilled in the art without departing from the scope of the teachings herein as to the design of a pitcher in which the liquids contained within flow from the bottom, while the pitcher continues to be tilted from the top. For at least such reason, therefore, resort should be had to the claims appended hereto for a true understanding of the scope of the invention.

I claim:

1. A pitcher comprising:

a receptacle having an open top, a closed bottom, a discharge spout at a first external side adjacent to the top of said receptacle, and a handle at a second external side, opposite to, and extending below said spout;

a cover lid flushingly fit with the top of said receptacle adjacent said spout towards said second side;

insert means having opposing edges secured to the interior of said receptacle proximate to and overlapping said spout, extending from a point slightly above the bottom of said receptacle to said flush cover lid;

with said opposing edges of said insert means being fitted flush to said interior of said receptacle yet open at a lower end thereof;

and with said insert means thereby forming a channel within the interior of said receptacle, through the lower end of which liquid at the bottom of said receptacle flows to exit through said discharge spout upon elevation of said receptacle by said handle.

2. The pitcher of claim 1 wherein said insert means extends from said flush cover lid to a point substantially ¼ inch above the bottom of said receptacle.

3. The pitcher of claim 1 wherein said flush cover lid extends substantially one-half way across said receptacle from said first side towards said second side.

4. The pitcher of claim 1 wherein said flush cover lid is comprised of two hinged sections, extending between said first and said second sides of said receptacle.

5. The pitcher of claim 1 wherein said flush cover lid is detachably securable to said receptacle.

* * * * *